US009076386B2

(12) United States Patent
Jeong

(10) Patent No.: US 9,076,386 B2
(45) Date of Patent: Jul. 7, 2015

(54) PIXEL, DISPLAY DEVICE INCLUDING THE SAME, AND DRIVING METHOD THEREOF

(71) Applicant: Samsung Display Co., Ltd., Yongin, Gyeonggi-do (KR)

(72) Inventor: Seon-I Jeong, Yongin (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 119 days.

(21) Appl. No.: 14/017,076

(22) Filed: Sep. 3, 2013

(65) Prior Publication Data

US 2014/0313233 A1 Oct. 23, 2014

(30) Foreign Application Priority Data

Apr. 17, 2013 (KR) ..... 10-2013-0042359

(51) Int. Cl.
*G09G 3/32* (2006.01)

(52) U.S. Cl.
CPC ..... *G09G 3/3258* (2013.01)

(58) Field of Classification Search
CPC ..... G09G 2300/0842; G09G 3/3233; G09G 3/3648
See application file for complete search history.

(56) References Cited

U.S. PATENT DOCUMENTS

2012/0068986 A1* 3/2012 Mizutani et al. ..... 345/211
2012/0248471 A1* 10/2012 Kishi ..... 257/88
2012/0287025 A1* 11/2012 Inoue et al. ..... 345/76
2013/0063041 A1* 3/2013 Kimura ..... 315/291

FOREIGN PATENT DOCUMENTS

KR 10-2007-0019463 A 2/2007
KR 10-2009-0056939 A 6/2009
KR 10-2010-0009219 A 1/2010

* cited by examiner

*Primary Examiner* — Kevin Nguyen
(74) *Attorney, Agent, or Firm* — Knobbe, Martens, Olson & Bear, LLP

(57) ABSTRACT

A display device is disclosed. In one aspect, the device includes a plurality of pixels, a scan driver sequentially applying scan signals at a gate-on voltage to a plurality of scan lines connected to a plurality of pixels and a data driver applying data signals to a plurality of data lines connected to a plurality of pixels in response to the scan signals at the gate-on voltage. The device also includes a power supply unit sequentially changing first power voltages at a high level voltage into a low level voltage and applying the changed voltages, and sequentially changing second power voltages at the low level voltage into the high level voltage and applying the changed voltages. The device further includes a light-emitting signal unit sequentially applying light-emitting signals at the gate-on voltage to a plurality of light-emitting lines connected to a plurality of pixels.

20 Claims, 3 Drawing Sheets

PIXEL, DISPLAY DEVICE INCLUDING THE SAME, AND DRIVING METHOD THEREOF

CROSS-REFERENCE TO RELATED APPLICATIONS

This application claims priority to and the benefit of Korean Patent Application No. 10-2013-0042359 filed in the Korean Intellectual Property Office on Apr. 17, 2013, the entire contents of which are incorporated herein by reference.

BACKGROUND

1. Field

The described technology generally relates to a pixel, a display device including the same, and a driving method thereof, and more particularly to a pixel for an active matrix type organic light-emitting diode display, a display device including the same, and a driving method thereof.

2. Description of the Related Technology

In an organic light-emitting diode (OLED) display, an OLED luminance is generally controlled by a current or a voltage. The OLED includes an anode layer and cathode layer forming an electric field, and an organic light-emitting material emitting light by the electric field.

Typically, an OLED display is classified into a passive matrix type OLED (PMOLED) display and an active matrix type OLED (AMOLED) display according to its driving mechanism.

AMOLED displays selectively performing lighting every unit pixel is becoming the mainstream technology in terms of a resolution, a contrast, and an operation speed.

As displays have increased in size, the number of pixels have increased to maintain a high resolution. In this situation, a simplified structure of the pixel may be beneficial.

The above information is designed to assist in understanding the disclosed technology and therefore it may contain information that does not constitute prior art.

SUMMARY OF CERTAIN INVENTIVE ASPECTS

One inventive aspect is a pixel configured to provide a high resolution of a display device, a display device including the same, and a driving method thereof.

One exemplary embodiment is a display device including a plurality of pixels, a scan driver, a data driver, a power supply unit, and a light-emitting signal unit. The scan driver sequentially applies scan signals at a gate-on voltage to a plurality of scan lines connected to a plurality of pixels. The data driver applies data signals to a plurality of data lines connected to a plurality of pixels in response to the scan signals at the gate-on voltage. The power supply unit sequentially changes first power voltages at a high level voltage applied to a plurality of first power lines connected to a plurality of pixels into a low level voltage and applies the changed voltages, and sequentially changes second power voltages at the low level voltage applied to a plurality of second power lines connected to a plurality of pixels into the high level voltage and applies the changed voltages. The light-emitting signal unit sequentially applies light-emitting signals at the gate-on voltage to a plurality of light-emitting lines connected to a plurality of pixels. Each of a plurality of pixels can be reset by applying the first power voltages at the low level voltage. Data can be written by applying the second power voltages at the high level voltage and applying the scan signals at the gate-on voltage. Light can be emitted by applying the light-emitting signals at the gate-on voltage.

Each of a plurality of pixels may include a switching transistor, a driving transistor, a compensation transistor, a light-emitting transistor, and a organic light-emitting diode. The switching transistor may include a gate electrode connected to any one scan line of a plurality of scan lines, an electrode connected to any one data line of a plurality of data lines, and another electrode connected to a first node. The driving transistor may include the gate electrode connected to a second node, the electrode connected to the first node, and another electrode connected to a third node. The compensation transistor may include the gate electrode connected to any one scan line, the electrode connected to the second node, and another electrode connected to the third node. The light-emitting transistor may include the gate electrode connected to any one light-emitting line of a plurality of light-emitting lines, the electrode connected to the first node, and another electrode connected to the first power voltages. The organic light-emitting diode may include an anode connected to the third node and another electrode connected to the second power voltages.

Each of a plurality of pixels may further include a storage capacitor including the electrode connected to the first power voltages and another electrode connected to the second node.

At least one of the switching transistor, the driving transistor, the compensation transistor, and the light-emitting transistor may be an oxide thin film transistor.

Another exemplary embodiment of the described technology provides a pixel including a switching transistor, a driving transistor, a compensation transistor, a light-emitting transistor, and an organic light-emitting diode. The switching transistor can include a gate electrode to which a scan signal can be applied, an electrode connected to a data line, and another electrode connected to a first node. The driving transistor can include the gate electrode connected to a second node, the electrode connected to the first node, and another electrode connected to a third node. The compensation transistor can include the gate electrode to which the scan signal can be applied, the electrode connected to the second node, and another electrode connected to the third node. The light-emitting transistor can include the gate electrode to which a light-emitting signal can be applied, the electrode connected to the first node, and another electrode connected to a first power voltage. The organic light-emitting diode can include an anode connected to the third node and another electrode connected to a second power voltage.

The pixel may further include a storage capacitor including the electrode connected to the first power voltage and another electrode connected to the second node.

At least one of the switching transistor, the driving transistor, the compensation transistor, and the light-emitting transistor may be an oxide thin film transistor.

Yet another exemplary embodiment of the described technology provides a driving method of a display device. The display device can include a switching transistor turned-on by scan signals at a gate-on voltage to transport data signals to a first node, a light-emitting transistor turned-on by light-emitting signals at the gate-on voltage to transport first power voltages to the first node, a driving transistor turned-on according to a voltage of a second node to control a driving current flowing from the first node to an organic light-emitting diode, a compensation transistor turned-on by the scan signals at the gate-on voltage to diode-connect the driving transistor, and a plurality of pixels connected between the first power voltages and the second node and including a storage capacitor. The driving method can include changing the first power voltages at a high level voltage into a low level voltage, resetting the voltage of the second node to the low level voltage due to coupling by the storage capacitor, turning-on the switching transistor and the compensation transistor by the scan signals at the gate-on voltage, storing a data voltage in the storage capacitor, turning-on the light-emitting transistor by the light-emitting signals at the gate-on voltage to allow a driving current to flow to the organic light-emitting diode, and allowing the organic light-emitting diode to emit light having brightness corresponding to the driving current.

The resetting of the voltage of the second node to the low level voltage may include sequentially changing the first power voltages at the high level voltage applied to a plurality of first power lines connected to a plurality of pixels into the low level voltage.

The storing of the data voltage in the storage capacitor may include sequentially applying the scan signals at the gate-on voltage to a plurality of scan lines connected to a plurality of pixels, and applying the data signals having a predetermined voltage range to a plurality of data lines connected to a plurality of pixels in response to the scan signals at the gate-on voltage.

The storing of the data voltage in the storage capacitor may include sequentially changing second power voltages at the low level voltage applied to a plurality of second power lines connected to a plurality of pixels into the high level voltage.

The allowing of the organic light-emitting diode to emit light having brightness corresponding to the driving current may include sequentially applying the light-emitting signals at the gate-on voltage to a plurality of light-emitting lines connected to a plurality of pixels.

A structure of a pixel can be simplified, thus improving an aperture ratio of a display device and ensuring a high resolution of the display device.

DETAILED DESCRIPTION OF CERTAIN INVENTIVE EMBODIMENTS

Figure 1:
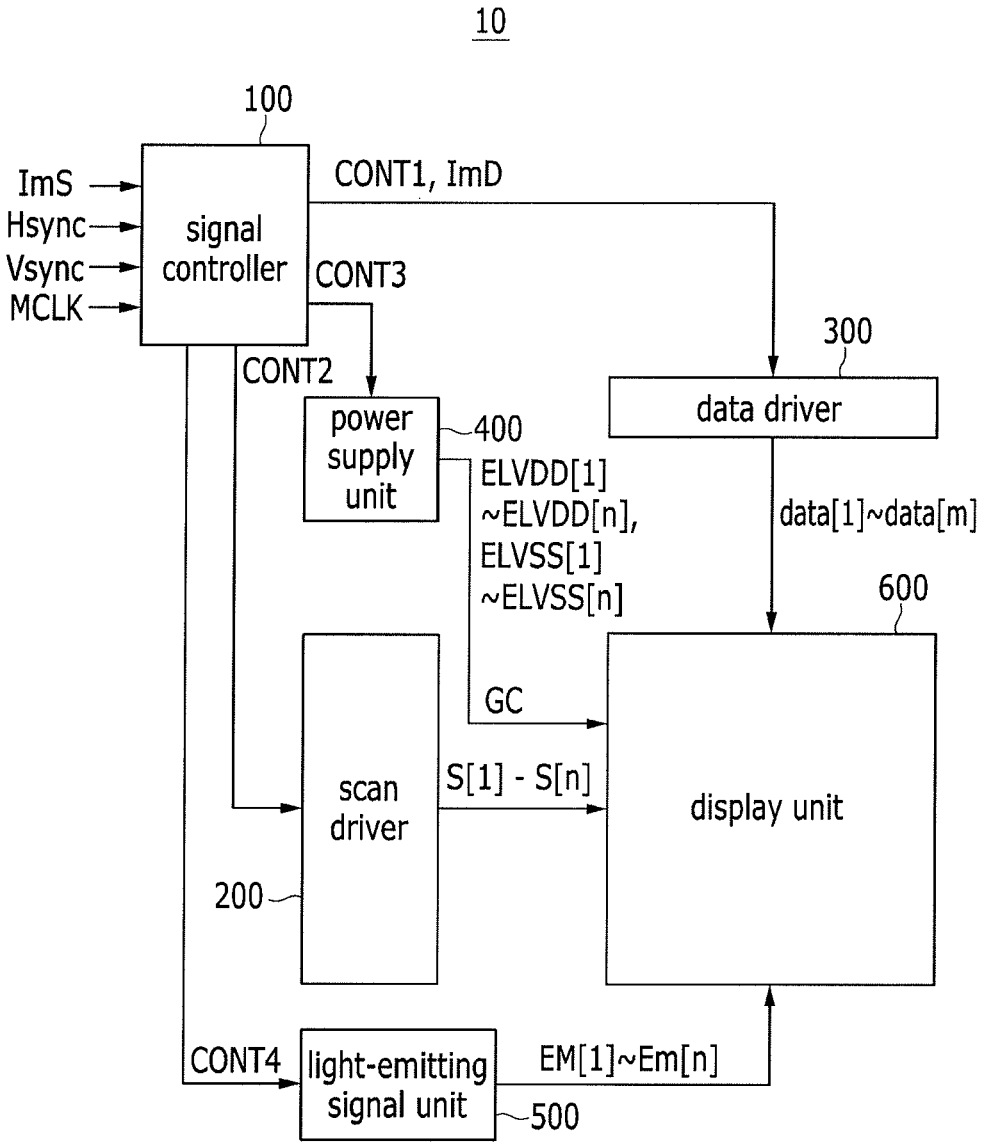
FIG. 1 is a block diagram showing a display device according to one exemplary embodiment.

Hereinafter, exemplary embodiments of the described technology will be described in detail with reference to the accompanying drawings so that those skilled in the art may easily practice the described technology. As those skilled in the art would realize, the described embodiments may be modified in various different ways, all without departing from the spirit or scope of the described technology.

In addition, in various exemplary embodiments, the same reference numerals are used in respects to the constituent elements having the same constitution.

Like reference numerals generally designate like elements throughout the specification.

Throughout this specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

FIG. 1 is a block diagram showing a display device according to an exemplary embodiment of the described technology.

Referring to FIG. 1, a display device 10 includes a signal controller 100, a scan driver 200, a data driver 300, a power supply unit 400, a light-emitting signal unit 500, and a display unit 600.

The signal controller 100 receives a video signal ImS and a synchronization signal received from an external device. The video signal ImS contains luminance information of a plurality of pixels. The luminance can have grayscales having a predetermined number, for example, 1024 ($=2^{10}$), 256 ($=2^{8}$), or 64 ($=2^{6}$) grayscales. The synchronization signal can include a horizontal synchronization signal Hsync, a vertical synchronization signal Vsync, and a main clock signal MCLK.

The signal controller 100 can generate a plurality of driving control signals CONT1 to CONT4 and an image data signal ImD according to the video signal ImS, the horizontal synchronization signal Hsync, the vertical synchronization signal Vsync, and the main clock signal MCLK.

The signal controller 100 can generate the image data signal ImD by dividing the video signal ImS in a frame unit according to the vertical synchronization signal Vsync, and dividing the video signal ImS in a scan line unit according to the horizontal synchronization signal Hsync. The signal controller 100 transports the image data signal ImD in conjunction with a first driving control signal CONT1 to the data driver 300.

The display unit 600 can be a display region including a plurality of pixels arranged in an approximately matrix form. In the display unit 600, a plurality of scan lines extending in an approximately row direction to be almost parallel to each other, a plurality of data lines extending in an approximately column direction to be almost parallel to each other, a plurality of power lines extending in an approximately row direction to be almost parallel to each other, and a plurality of light-emitting lines extending in an approximately row direction to be almost parallel to each other are formed to be connected to a plurality of pixels. A plurality of power lines can include a plurality of first power lines to which a plurality of first power voltages ELVDD[1]-ELVDD[n] is applied, and a plurality of second power lines to which a plurality of second power voltages ELVSS[1]-ELVSS[n] is applied.

The scan driver 200 is connected to a plurality of scan lines, and generates a plurality of scan signals S[1]-S[n] according to the second driving control signal CONT2. The scan driver 200 may sequentially apply the scan signals S[1]-S[n] at a gate-on voltage to a plurality of scan lines.

The data driver 300 is connected to a plurality of data lines, and samples and holds the image data signal ImD inputted according to the first driving control signal CONT1. The data driver 300 transports a plurality of data signals data[1]-data[m] to a plurality of data lines. The data driver 300 may apply the data signals data[1]-data[m] having a predetermined voltage range to a plurality of data lines in response to the scan signals S[1]-S[n] at the gate-on voltage.

The power supply unit 400 is connected to a plurality of power lines. The power supply unit 400 determines levels of a plurality of first power voltages ELVDD[1]-ELVDD[n] and the second power voltages ELVSS[1]-ELVSS[n] according to a third driving control signal CONT3. The power supply unit 400 may sequentially change the first power voltages ELVDD[1]-ELVDD[n] at the high level voltage applied to a plurality of first power lines into the low level voltage. In addition, the power supply unit 400 may sequentially change the second power voltages ELVSS[1]-ELVSS[n] at the low level applied to a plurality of second power lines into the high level voltage.

The light-emitting signal unit 500 is connected to a plurality of light-emitting lines, and generates a plurality of light-emitting signals EM[1]-EM[n] according to a fourth driving control signal CONT4. The light-emitting signal unit 500 may sequentially apply the light-emitting signals EM[1]-EM[n] at the gate-on voltage to a plurality of light-emitting lines.

Figure 2:
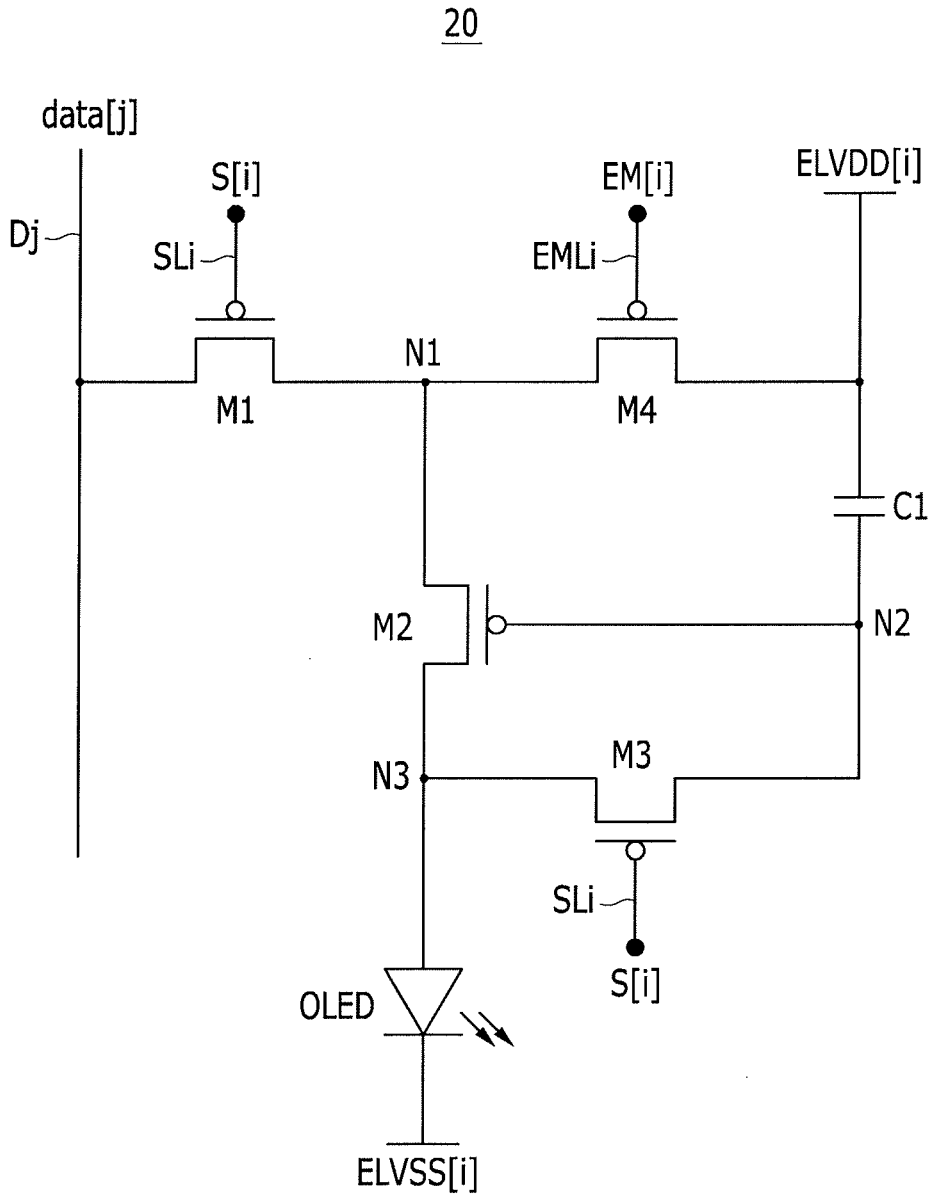
FIG. 2 is a circuit diagram showing a pixel.

FIG. 2 is a circuit diagram showing an example of a pixel. FIG. 2 shows any one pixel of a plurality of pixels that can be used in the display device 10 of FIG. 1.

Referring to FIG. 2, a pixel 20 includes a switching transistor M1, a light-emitting transistor M2, a compensation transistor M3, a light-emitting transistor M4, a storage capacitor C1, and an organic light-emitting diode (OLED).

The switching transistor M1 includes a gate electrode connected to a scan line SLi, an electrode connected to a data line Dj, and another electrode connected to a first node N1. The switching transistor M1 is turned-on by the scan signal S[i] of the gate-on voltage applied to the scan line SLi to transport the data signal data[j] applied to the data line Dj to the first node N1.

The driving transistor M2 includes the gate electrode connected to a second node N2, the electrode connected to the first node N1, and another electrode connected to a third node N3. The driving transistor M2 controls a driving current supplied from the first power voltage ELVDD to the organic light-emitting diode (OLED).

The compensation transistor M3 includes the gate electrode connected to the scan line SLi, the electrode connected to the second node N2, and another electrode connected to the third node N3. The compensation transistor M3 is turned-on by the scan signal S[i] at the gate-on voltage to diode-connect the driving transistor M2.

The light-emitting transistor M4 includes the gate electrode connected to a light-emitting line EMLi, the electrode connected to the first node N1, and another electrode connected to the first power voltage ELVDD[i]. The light-emitting transistor M4 is turned-on by the light-emitting signal EM[i] at the gate-on voltage to transport the first power voltage ELVDD[i] to the first node N1.

The storage capacitor C1 includes the electrode connected to the first power voltage ELVDD[i] and another electrode connected to the second node N2.

The OLED includes an anode connected to the third node N3 and a cathode connected to the second power voltage ELVSS[i]. The OLED includes an organic emission layer emitting light having any color such as red, green or blue. A desired color may be displayed using a spatial or temporal sum of the colors.

The switching transistor M1, the driving transistor M2, the compensation transistor M3, and the light-emitting transistor M4 may be a p-channel field effect transistor. In this case, the gate-on voltage turning-on the switching transistor M1, the driving transistor M2, the compensation transistor M3, and the light-emitting transistor M4 is a low level voltage. A gate off voltage turning-off the switching transistor M1, the driving transistor M2, the compensation transistor M3, and the light-emitting transistor M4 is a high level voltage.

The p-channel field effect transistor is shown herein, but at least one of the switching transistor M1, the driving transistor M2, the compensation transistor M3, and the light-emitting transistor M4 may be an n-channel field effect transistor. In this case, the gate-on voltage turning-on the n-channel field effect transistor is the high level voltage. The gate off voltage turning-off the n-channel field effect transistor is the low level voltage.

At least one of the switching transistor M1, the driving transistor M2, the compensation transistor M3, and the light-emitting transistor M4 may be an oxide thin film transistor (oxide TFT) including a semiconductor layer formed of an oxide semiconductor.

The oxide semiconductor may include any one of oxides having titanium (Ti), hafnium (Hf), zirconium (Zr), aluminum (Al), tantalum (Ta), germanium (Ge), zinc (Zn), gallium (Ga), tin (Sn), or indium (In) as a base, and complex oxides thereof, such as zinc oxide (ZnO), indium-gallium-zinc oxide (InGaZnO4), indium-zinc oxide (Zn—In—O), zinc-tin oxide (Zn—Sn—O), indium-gallium oxide (In—Ga—O), indium-tin oxide (In—Sn—O), indium-zirconium oxide (In—Zr—O), indium-zirconium-zinc oxide (In—Zr—Zn—O), indium-zirconium-tin oxide (In—Zr—Sn—O), indium-zirconium-gallium oxide (In—Zr—Ga—O), indium-aluminum oxide (In—Al—O), indium-zinc-aluminum oxide (In—Zn—Al—O), indium-tin-aluminum oxide (In—Sn—Al—O), indium-aluminum-gallium oxide (In—Al—Ga—O), indium-tantalum oxide (In—Ta—O), indium-tantalum-zinc oxide (In—Ta—Zn—O), indium-tantalum-tin oxide (In—Ta—Sn—O), indium-tantalum-gallium oxide (In—Ta—Ga—O), indium-germanium oxide (In—Ge—O), indium-germanium-zinc oxide (In—Ge—Zn—O), indium-germanium-tin oxide (In—Ge—Sn—O), indium-germanium-gallium oxide (In—Ge—Ga—O), titanium-indium-zinc oxide (Ti—In—Zn—O), and hafnium-indium-zinc oxide (Hf—In—Zn—O).

The semiconductor layer includes a channel region not doped with an impurity, and a source region and a drain region formed at both sides of the channel region to be doped with the impurity. Herein, the impurity depends on a type of thin film transistor, and an N type impurity or a P type impurity can be used.

When the semiconductor layer is formed of the oxide semiconductor, a separate passivation layer may be added to protect the oxide semiconductor weak to an external environment such as high temperatures when exposed to high temperatures.

In addition, the organic emission layer of the OLED may be formed of a low molecular organic material or a high molecular organic material such as PEDOT (poly 3,4-ethylenedioxythiophene). Further, the organic emission layer may be formed of a multilayer including one or more of an emission layer, a hole injection layer HIL, a hole transport layer HTL, an electron transport layer ETL, and an electron injection layer EIL. When all the layers are included, the hole injection layer HIL is formed on a pixel electrode that is the anode. The hole transport layer HTL, the emission layer, the electron transport layer ETL, and the electron injection layer EIL are sequentially laminated thereon.

The organic emission layer may include a red organic emission layer emitting light having a red color, a green organic emission layer emitting light having a green color, and a blue organic emission layer emitting light having a blue color. The red organic emission layer, the green organic emission layer, and the blue organic emission layer are formed in a red pixel, a green pixel, and a blue pixel, respectively, to form a color image.

Further, the organic emission layer may form the color image by laminating all of the red organic emission layer, the green organic emission layer, and the blue organic emission layer in the red pixel, the green pixel, and the blue pixel together, and forming a red color filter, a green color filter, and a blue color filter for each pixel. In another example, a white organic emission layer emitting light having a white color may be formed in all of the red pixel, the green pixel, and the blue pixel, and the red color filter, the green color filter, and the blue color filter may be formed for each pixel to form the color image. When the color image is formed using the white organic emission layer and the color filter, deposition masks for depositing the red organic emission layer, the green organic emission layer, and the blue organic emission layer on each pixel, that is, the red pixel, the green pixel, and the blue pixel may not be needed.

Needless to say, the white organic emission layer described in another example may be formed of one organic emission layer, and can include even a constitution where a plurality of organic emission layers are laminated to emit light having the white color. For example, a constitution where at least one yellow organic emission layer and at least one blue organic emission layer are combined to emit light having the white color, a constitution where at least one cyan organic emission layer and at least one red organic emission layer are combined to emit light having the white color, or a constitution where at least one magenta organic emission layer and at least one green organic emission layer are combined to emit light having the white color may be included.

Figure 3:
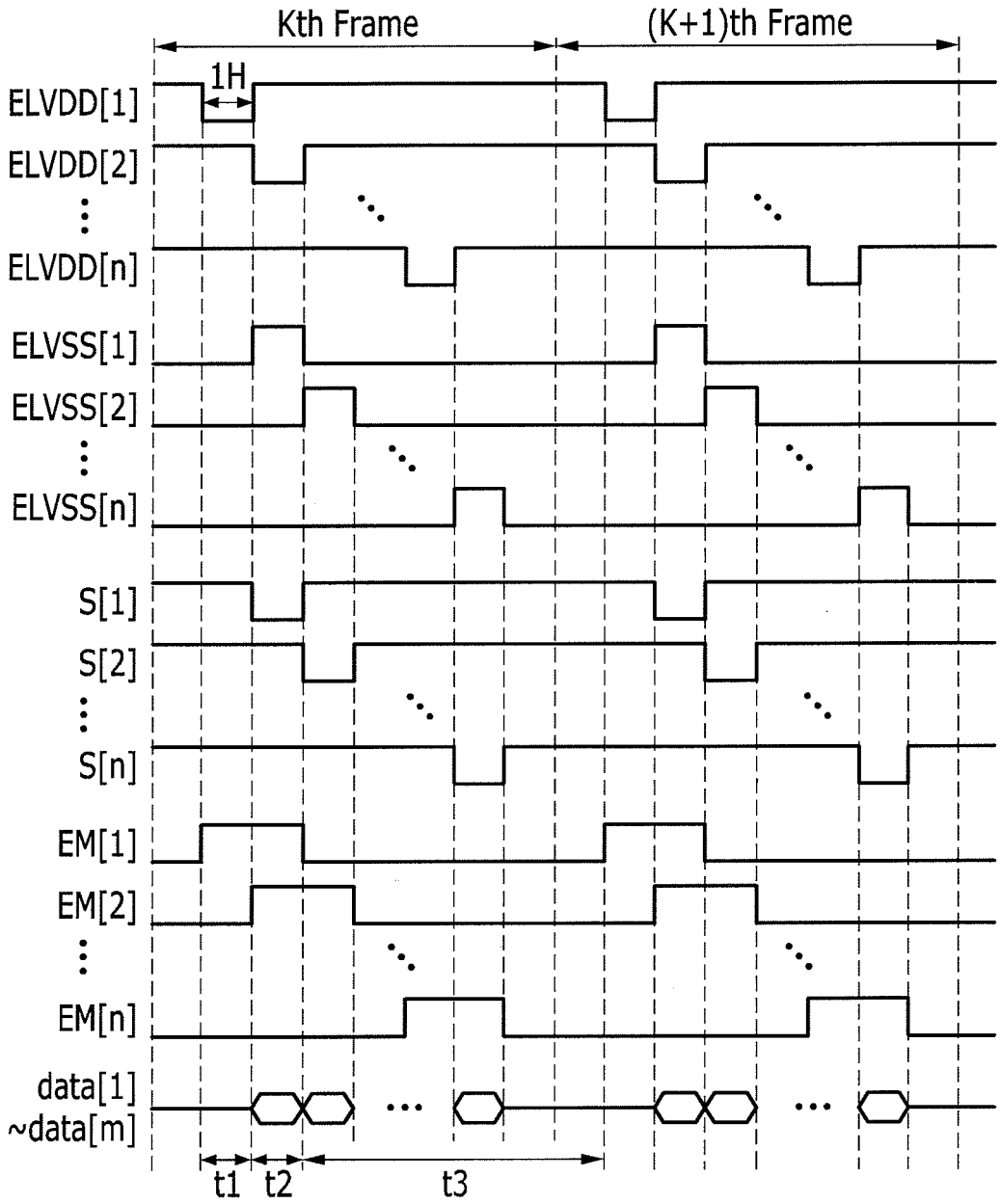
FIG. 3 is a timing diagram showing a driving method of the display device.

FIG. 3 is a timing diagram showing a driving method of the display device according to an exemplary embodiment of the described technology.

Referring to FIGS. 1 to 3, when a plurality of first power voltages ELVDD[1]-ELVDD[n] are applied at the high level voltage in one frame (kth frame), the first power voltages are sequentially applied at the low level voltage during one horizontal period 1H. The one horizontal period 1H may be substantially the same as a period of the horizontal synchronization signal Hsync.

In this case, when the second power voltages ELVSS[1]-ELVSS[n] are applied at the low level voltage, the second power voltages are sequentially applied at the high level voltage during one horizontal period 1H while delayed for the one horizontal period 1H as compared to an application time of the first power voltages ELVDD[1]-ELVDD[n] at the low level voltage.

A plurality of scan signals S[1]-S[n] are sequentially applied at the gate-on voltage for substantially the same time as the time at which the second power voltages ELVSS[1]-ELVSS[n] are sequentially applied at the high level voltage.

A plurality of light-emitting signals EM[1]-EM[n] start to be sequentially applied at the gate-on voltage while delayed for the one horizontal period 1H as compared to the application time of the scan signals S[1]-S[n] at the gate-on voltage. In addition, a plurality of light-emitting signals EM[1]-EM[n] are maintained at the gate-on voltage until the first power voltages ELVDD[1]-ELVDD[n] are applied at the low level voltage during the next frame (k+1th frame).

First, an operation of the pixels arranged in the first scan line will be described.

The first power voltage ELVDD[1] applied at the high level voltage is changed into the low level voltage during a t1 period. In this case, the second power voltage ELVSS[1] is applied at the low level voltage. In addition, the scan signal S[1] and the light-emitting signal EM[1] are applied at the gate off voltage. In accordance with the change of the first power voltage ELVDD[1] into the low level voltage, the voltage of the second node N2 is reduced to the low level voltage due to coupling by the storage capacitor C1. That is, the gate voltage of the driving transistor M2 is reset to the low level voltage.

The first power voltage ELVDD[1] and the second power voltage ELVSS[1] are applied at the high level voltage during a t2 period. In this case, the light-emitting signal EM[1] is applied at the gate off voltage, and the scan signal S[1] is applied at the gate-on voltage. In accordance with application of the scan signal S[1] at the gate-on voltage, the switching transistor M1 and the compensation transistor M3 are turned-on. The data signals data[1]-data[m] are applied to a plurality of data lines in response to the scan signal S[1] at the gate-on voltage. A data voltage Vdat is applied through the turned-on switching transistor M1 to the first node N1. In accordance with turning-on of the compensation transistor M3, the driving transistor M2 is diode-connected, and a Vdat-Vth voltage is applied to the second node N2. A ELVDD−(Vdat−Vth) voltage is stored in the storage capacitor C1. The Vth is a threshold voltage of the driving transistor M2, and the ELVDD is the first power voltage ELVDD[1] at the high level voltage. In this case, since the second power voltage ELVSS [1] is applied at the high level voltage, a current does not flow through the OLED.

In some embodiments, the first power voltage ELVDD[1] is maintained at the high level voltage, and the second power voltage ELVSS[1] is applied at the low level voltage during a t3 period. In this case, the scan signal S[1] is applied at the gate off voltage, and the light-emitting signal EM[1] is applied at the gate-on voltage. The t3 period is a time at which the light-emitting signal EM[1] is applied at the gate-on voltage to allow the OLED to emit light. The light-emitting signal EM[1] is applied at the gate-on voltage until the first power voltage ELVDD[1] is applied at the low level voltage during the next frame (k+1)th frame) after the second power voltage ELVSS[1] is applied at the low level voltage. In accordance with application of the light-emitting signal EM[1] at the gate-on voltage, the light-emitting transistor M4 is turned-on, and the first power voltage ELVDD[1] at the high level voltage is transported to the first node N1. Accordingly, a driving current Ioled corresponding to Ioled (=k(Vgs−Vth)=k [(ELVDD−(Vdat−Vth)−Vth]=k (ELVDD−Vdat) flows through the driving transistor M2 to the organic light-emitting diode. Herein, k is a parameter according to a characteristic of the driving transistor M2. The OLED emits light having brightness corresponding to the driving current Ioled.

The t1 period may be a reset period during which a reset operation of the gate voltage of the driving transistor M2 is performed, and the t2 period may be a data writing period during which a writing operation of the data signal on the pixel is performed. The t3 period may be a light-emitting period during which a light-emitting operation of the OLED in response to the data signal is performed.

The first power voltage ELVDD[2], the second power voltage ELVSS[2], the scan signal S[2], and the light-emitting signal EM[2] applied to the pixels arranged in the second scan line are delayed for the one horizontal period as compared to the first power voltage ELVDD[1], the second power voltage ELVSS[1], the scan signal S[1], and the light-emitting signal EM[1] applied to the pixels arranged in the first scan line. Therefore, the reset operation, the data writing operation, and the light-emitting operation of the pixels arranged in the second scan line are performed while delayed for the one horizontal period as compared to the pixels arranged in the first scan line.

According to the aforementioned procedure, the reset operation, the data writing operation, and the light-emitting operation of the pixels arranged in the first scan line to the last scan line can be sequentially performed.

According to at least one of the disclosed embodiments, the pixel has a simple structure including four transistors and one capacitor. Accordingly, it is possible to improve an aperture ratio of the display device and ensure a high resolution of the display device.

The above description is for illustrative purpose only and not intended to limit the meanings or a range of the described technology described in claims. Therefore, it is understood that various modifications and the corresponding other exemplary embodiments may be possible by those who are skilled in the art. Accordingly, the technical protection range of the described technology may depend on the technical spirit of the accompanying claims.

What is claimed is:

1. A display device comprising:

a plurality of pixels;

a scan driver configured to sequentially apply scan signals at a gate-on voltage to a plurality of scan lines electrically connected to the pixels;

a data driver configured to apply data signals to a plurality of data lines electrically connected to the pixels in response to the scan signals having the gate-on voltage;

a power supply unit configured to sequentially change a plurality of first power voltages each having a high level voltage, applied to a plurality of first power lines electrically connected to the pixels, into a low level voltage and apply the changed low level voltages, and sequentially change a plurality of second power voltages each having the low level voltage, applied to a plurality of second power lines electrically connected to the pixels, into the high level voltage and apply the changed high level voltages; and a light-emitting signal unit configured to sequentially apply light-emitting signals having the gate-on voltage to a plurality of light-emitting lines electrically connected to the pixels, wherein each of the pixels is configured to be reset by the first power voltages having the low level voltage, wherein data are configured to be written by the second power voltages having the high level voltage and the scan signals having the gate-on voltage, and wherein the pixels are configured to emit light based at least in part on the light-emitting signals having the gate-on voltage.

2. The display device of claim 1, wherein each of the pixels comprises a switching transistor including i) a gate electrode electrically connected to a selected one of the scan lines, ii) a first electrode electrically connected to a selected one of the data lines and iii) a second electrode electrically connected to a first node;

a driving transistor including i) a gate electrode electrically connected to a second node, ii) a first electrode electrically connected to the first node and iii) a second electrode electrically connected to a third node;

a compensation transistor including i) a gate electrode electrically connected to a selected scan line, ii) a first electrode electrically connected to the second node and iii) a second electrode electrically connected to the third node;

a light-emitting transistor including i) a gate electrode electrically connected to light-emitting a selected one of the light-emitting lines, ii) a first electrode electrically connected to the first node and iii) a second electrode electrically connected to the first power voltages; and an organic light-emitting diode including a first electrode electrically connected to the third node and a second electrode electrically connected to the second power voltages.

3. The display device of claim 2, wherein each of the pixels further comprises a storage capacitor including a first electrode electrically connected to the first power voltages and a second electrode electrically connected to the second node.

4. The display device of claim 2, wherein at least one of the switching transistor, the driving transistor, the compensation transistor, and the light-emitting transistor is an oxide thin film transistor.

5. A pixel comprising:

a switching transistor including a gate electrode to which a scan signal is applied, a first electrode electrically connected to a data line, and a second electrode electrically connected to a first node;

a driving transistor including a gate electrode electrically connected to a second node, a first electrode electrically connected to the first node, and a second electrode electrically connected to a third node;

a compensation transistor including a gate electrode to which the scan signal is applied, a first electrode electrically connected to the second node, and a second electrode electrically connected to the third node;

a light-emitting transistor including a gate electrode to which a light-emitting signal is applied, a first electrode electrically connected to the first node, and a second electrode electrically connected to a first power voltage; and an organic light-emitting diode including a first electrode electrically connected to the third node and a second electrode electrically connected to a second power voltage.

6. The pixel of claim 5, further comprising:

a storage capacitor including a first electrode electrically connected to the first power voltage and a second electrode electrically connected to the second node.

7. The pixel of claim 5, wherein at least one of the switching transistor, the driving transistor, the compensation transistor, and the light-emitting transistor is an oxide thin film transistor.

8. A driving method of a display device including a switching transistor configured to be turned-on by scan signals at a gate-on voltage to transport data signals to a first node, a light-emitting transistor configured to be turned-on by light-emitting signals at the gate-on voltage to transport first power voltages to the first node, a driving transistor configured to be turned-on according to a voltage of a second node to control a driving current flowing from the first node to an organic light-emitting diode (OLED), a compensation transistor configured to be turned-on by the scan signals at the gate-on voltage to diode-connect the driving transistor, and a plurality of pixels electrically connected between the first power voltages and the second node and including a storage capacitor electrically connected to the pixels, the method comprising:

changing the first power voltages having a high level voltage into a low level voltage, and resetting the voltage of the second node to the low level voltage based at least in part on coupling by the storage capacitor;

turning-on the switching transistor and the compensation transistor based at least in part on the scan signals having the gate-on voltage, and storing a data voltage in the storage capacitor; and turning-on the light-emitting transistor based at least in part on the light-emitting signals having the gate-on voltage to allow a driving current to flow to the OLED, and controlling the OLED to emit light having brightness corresponding to the driving current.

9. The driving method of claim 8, wherein the resetting comprises:

sequentially changing the first power voltages having the high level voltage into the low level voltage, wherein the first power voltages are applied to a plurality of first power lines electrically connected to the pixels.

10. The driving method of claim 8, wherein the storing comprises:

sequentially applying the scan signals having the gate-on voltage to a plurality of scan lines electrically connected to the pixels; and applying the data signals having a predetermined voltage range to a plurality of data lines electrically connected to the pixels in response to the scan signals having the gate-on voltage.

11. The driving method of claim 10, wherein the storing comprises:

sequentially changing a plurality of second power voltages each having the low level voltage into the high level voltage, wherein the second power voltages are applied to a plurality of second power lines electrically connected to the pixels.

12. The driving method of claim 8, wherein the allowing comprises:

sequentially applying the light-emitting signals having the gate-on voltage to a plurality of light-emitting lines electrically connected to the pixels.

13. A display device comprising:

a plurality of pixels;

a plurality of first power lines electrically connected to the pixels and configured to respectively receive a plurality of first power voltages each having a high level voltage;

a plurality of second power lines electrically connected to the pixels and configured to respectively receive a plurality of second power voltages each having a low level voltage; and a power supply configured to sequentially change each of the first power voltages into the low level voltage and sequentially change each of the second power voltages into the high level voltage.

14. The display device of claim 13, further comprising:

a scan driver configured to sequentially apply scan signals having a gate-on voltage to a plurality of scan lines electrically connected to the pixels;

a data driver configured to apply data signals to a plurality of data lines electrically connected to the pixels in response to the scan signals having the gate-on voltage; and a light-emitting signal unit configured to sequentially apply light-emitting signals having the gate-on voltage to a plurality of light-emitting lines electrically connected to the pixels.

15. The display device of claim 14, wherein data are configured to be written by the second power voltages having the high level voltage and the scan signals having the gate-on voltage.

16. The display device of claim 14, the pixels are configured to emit light based at least in part on the light-emitting signals having the gate-on voltage.

17. The display device of claim 13, wherein each of the pixels is configured to be reset by the first power voltages having the low level voltage.

18. The display device of claim 13, wherein each of the pixels further comprises a storage capacitor including a first electrode electrically connected to the first power voltages and a second electrode electrically connected to the second node.

19. The display device of claim 13, wherein each of the pixels comprises a switching transistor including i) a gate electrode electrically connected to a selected one of the scan lines, ii) a first electrode electrically connected to a selected one of the data lines and iii) a second electrode electrically connected to a first node;

a driving transistor including i) a gate electrode electrically connected to a second node, ii) a first electrode electrically connected to the first node and iii) a second electrode electrically connected to a third node;

a compensation transistor including i) a gate electrode electrically connected to a selected scan line, ii) a first electrode electrically connected to the second node and iii) a second electrode electrically connected to the third node;

a light-emitting transistor including i) a gate electrode electrically connected to a selected one of the light-emitting lines, ii) a first electrode electrically connected to the first node and iii) a second electrode electrically connected to the first power voltages; and an organic light-emitting diode including a first electrode electrically connected to the third node and a second electrode electrically connected to the second power voltages.

20. The display device of claim 19, wherein at least one of the switching transistor, the driving transistor, the compensation transistor, and the light-emitting transistor is an oxide thin film transistor.

* * * * *